US005789130A

United States Patent [19]

Suzuki et al.

[11] Patent Number: 5,789,130

[45] Date of Patent: Aug. 4, 1998

[54] RESIN COMPOSITION FOR TONER

[75] Inventors: Tatsuo Suzuki; Takayoshi Matsunaga, both of Shiga-Ken, Japan

[73] Assignee: Sekisui Chemical Kogyo Kabushiki Kaisha, Osaka, Japan

[21] Appl. No.: 739,655

[22] Filed: Oct. 31, 1996

Related U.S. Application Data

[63] Continuation-in-part of Ser. No. 165,329, Dec. 13, 1993, abandoned.

[51] Int. Cl.[6] ..... G03G 9/087

[52] U.S. Cl. ..... 430/109; 525/125; 525/130; 525/131; 525/455

[58] Field of Search ..... 430/109; 525/125, 525/131, 130, 455

[56] References Cited

U.S. PATENT DOCUMENTS

| | | | |
|---|---|---|---|
| 4,833,057 | 5/1989 | Misawa et al. | 430/109 |
| 4,931,375 | 6/1990 | Akimoto | 430/109 |
| 4,968,574 | 11/1990 | Morita | 430/109 |
| 5,427,883 | 6/1995 | Misawa | 430/109 |

FOREIGN PATENT DOCUMENTS

| | | |
|---|---|---|
| 56-158340 | 12/1981 | Japan . |
| 58-202455 | 11/1983 | Japan . |

*Primary Examiner*—Patricia A. Short
*Attorney, Agent, or Firm*—Townsend & Banta

[57] ABSTRACT

A toner resin composition is provided containing as a main component a vinyl copolymer having a higher molecular weight component with a peak value of molecular weight distribution of $2\times10^5$–$2\times10^6$ and a lower molecular weight component with a peak value of molecular weight distribution of from $4\times10^3$–$8\times10^4$, and a thermoplastic polyester urethane of a weight average molecular weight of from about 5,000–500,000 in a ratio of 0.01 to 30 wt. % of the total resin composition.

13 Claims, No Drawings

RESIN COMPOSITION FOR TONER

CROSS REFERENCE TO A RELATED APPLICATIONS

This is a continuation-in-part-of patent application of co-pending application Ser. No. 08/165,329 filed Dec. 13, 1993 now abandoned.

BACKGROUND OF THE INVENTION

This invention relates in general to a toner resin composition which contains vinyl copolymer as the main component and is used in electrophotography and such, and more particularly, to a toner resin composition which can be used in the so-called dry developing method in the electrostatic charge image development method.

DESCRIPTION OF RELATED ART

The dry developing method is frequently used as a method of developing electrostatic images in electrophotography and such. In the dry developing method, fine powder developing agents capable of frictional electrification are used. These agents comprise conductive particles such as carbon black dispersed in a toner resin. Typically, toner electrified by friction is adhered to electrostatic latent images on a photosensitive matter by electrical attraction to form toner images. These toner images are then transferred onto a paper sheet and fixed by thermal rolls and such to form permanent visible images.

As the fixing method, the heated roller method is widely used, which is carried out by feeding said paper sheet through a heated roller(s) which has a toner-release material formed on its surface, with the paper sheet surface on which the toner images are formed being compressed onto said roller surface. In the heated roller method, in order to increase cost performance by reducing power consumption and also to increase the copying speed, there is demand for a toner resin which can be fixed at lower temperatures.

For increasing the low temperature fixability of a toner resin which has vinyl copolymer as the main component, methods such as lowering the molecular weight of said vinyl polymer have been proposed. However, although fixability of the toners is improved by lowering the molecular weight of the vinyl copolymer, there are problems in that a phenomenon occurs in which part of the image forming toner is transferred to the surface of the heated roller during fixation, and the toner is then transferred to the next paper sheet which contaminates the images (hereafter referred to as "the offset phenomenon"). Also during this phenomenon the toner tends to aggregate.

To prevent the offset phenomenon, a technique of preparing a toner resin with a lower molecular weight polymer component and a higher molecular weight polymer component have been proposed (Japanese unexamined patent publication (Tokkai) Sho 56-158340, Tokkai Sho 58-202455).

Although use of a toner resin comprising a lower molecular polymer component and a higher molecular polymer component improved the offset phenomenon, insufficient tenacity of the resin caused problems in that the white areas with no toner were smeared when the fixed paper was rubbed (the so-called "smearing").

The introduction of crosslinking reactions or the addition of rubber to the toner resin may help increase the tenacity of the toner resin. However, simply adding rubber results in insufficient dispersibility, causing problems such as the so-called "fogging" phenomenon and aggravated aggregation. Furthermore, a resin mainly composed of the vinyl copolymer as mentioned above is easily pulverized; consequently, the toner tends to gradually turn into fine powder in the developing device, thus contaminating the carrier. When the carrier is contaminated, it becomes harder to cause frictional electrification, resulting in "fogging" during the run. There is disclosed in U.S. Pat. No. 4,833,057 to Misawa et al. a toner composition comprising as a main component a urethane-modified polyester resin which is mixed with a lower molecular weight vinyl copolymer. The Misawa et al. patent discloses that if the amount of the urethane-modified polyester resin is smaller than 30% by weight based on the sum of both resins the offset resistance of the toner is degraded and no good results can be obtained.

Therefore, the object of this invention is to provide a toner resin composition which not only is superior in low temperature fixability and anti-offset properties, but also prevents smearing and image fogging, particularly image fogging during the run, and also is superior in anti-aggregation properties.

SUMMARY OF THE INVENTION

A toner resin composition is provided which contains vinyl copolymer as the main component wherein said vinyl copolymer consists of at least a lower molecular weight polymer component and a higher molecular weight component, and thermo-plastic polyester urethane of a weight-average molecular weight of 5,000 or more is chemically bonded to said vinyl copolymer in a ratio of 0.01% to 30 wt % of the total resin composition. In the toner resin composition containing vinyl copolymer as the main component, wherein said vinyl copolymer consists of at least a lower molecular weight polymer component and a higher molecular weight component, the thermo-plastic polyester urethane can have a weight-average molecular weight of 5,000 or more and can be present in a ratio of 3% to 30 wt % of the whole.

DESCRIPTION OF PREFERRED EMBODIMENTS

It was unexpectedly discovered that a toner resin composition having excellent offset resistance and other properties could be obtained with the toner resin composition of the present invention which contains preferably 0.1–25 wt % of a thermoplasic polyester urethane chemically bonded to a vinyl copolymer which comprises the main component of the resin composition.

For the vinyl copolymer used in this invention, those which have styrene monomers, acrylic acid ester or methacrylic acid ester monomers as structural units are preferable.

Examples of the preferred styrene type monomers mentioned above are: styrene, o-methylstyrene, m-methylstyrene, p-methylstyrene, alpha-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyreneand3,4-dichlorostyrene.

Examples of the preferred acrylic acid ester and methacrylic acid ester monomers mentioned above are: alkyl esters of acrylic acid or methacrylic acid, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate and stearyl methacrylate; and also 2-chloroethyl acrylate, phenyl acrylate, methyl alpha-chloro acrylate, phenyl methacrylate, demethylaminoethyl methacrylate, diethylaminoethyl methacrylate, 2-hydroxyethyl methacrylate, glycidyl methacrylate, bisglycidyl methacrylate, polyetheleneglycol dimethacrylate and methacryloxyethyl phosphate. More preferably used are ethyl acrylate, propyl acrylate, butyl acrylate, methyl methacrylate, ethyl methacrylate, propyl methacrylate and butyl methacrylate.

Examples of other preferred vinyl type monomers used in this invention are: acrylic acid and its alpha- or beta-alkyl derivatives such as acrylic acid, methacrylic acid, alpha-ethyl acrylic acid and crotonic acid; unsaturated dicarbonic acids as well as their mono ester derivatives and diester derivatives such as fumaric acid, maleic acid, citraconic acid and itaconic acid; and also monoacryloyloxyethyl ester of succinic acid, monomethacryloyloxyethyl ester of succinic acid, acrylonitrile, methacrylonitrile and acrylamide.

Selection of the vinyl copolymer used in this invention is not limited in particular as long as its molecular weight distribution curve has at least two peaks from the lower molecular weight component and the higher molecular weight component, and it is normally used as a toner resin. It is preferred that the peak value of the molecular weight distribution of the lower molecular weight component is in the range of $4\times10^3$–$8\times10^4$, and that the peak value of the molecular weight distribution of the higher molecular weight component is in the range of $2\times10^5$–$2\times10^6$.

The molecular weight distribution is a curve obtained by gel permeation chromatography (GPC). Gel permeation chromatography is a form of liquid chromatography which sorts polymer molecules in a gel-packed column according to their size in solution. The molecular weight distribution curve obtained by GPC has peaks and troughs. The peaks indicate a higher concentration, relative to other polymers present in the solution, of the polymer indicated at the location of the peak on the horizontal axis of the curve. Therefore, the peak value of molecular weight distribution indicates the relative amount of a polymer present in the solution rather than the weight average or number average molecular weight of the component indicated by the location of the peak on the distribution curve.

If the peak value of the molecular weight distribution of the lower molecular weight component is significantly lower than the range mentioned above, then the aggregation properties may deteriorate. On the other hand, if it is significantly higher than the range mentioned above, then the fixability may become poor. If the peak value of the molecular weight distribution of the higher molecular weight component is significantly lower than the range mentioned above, then the anti-offset properties may deteriorate. On the other hand, if it is significantly higher than the range mentioned above, then the fixability may become poor. In the vinyl copolymer mentioned above which has at least 2 peaks from the lower molecular weight component and the higher molecular weight component in its molecular weight distribution curve, it is desirable to have not less than 15 wt % of the content of the higher molecular weight component because the anti-offset properties would become poor.

The thermoplastic polyester urethane used in this invention is preferably an elastomer which has urethane bonds in molecular chains. This resin is composed of a linear polymer obtained typically through a reaction between approximately equal amounts of active hydroxyl groups of saturated polyester, obtained by the condensation reaction between a polybasic acid with two or more carboxyl groups and dihydric alcohol, and isocyanate groups of a diisocyanate compound.

For the polybasic acid mentioned above, adipic acid, azelaic acid, sebacic acid, dodecanedioic acid, terephthalic acid, isophthalic acid, phthalic acid, succinic acid, etc. are used. For the dihydric alcohol mentioned above, ethylene glycol, 1,2-propylene glycol, 1,4-butanediol, 1,6-hexanediol, neopentyl glycol, diethylene glycol, triethylene glycol, polyethylene glycol, propylene glycol, polycaprolactone, etc. are used. For the diisocyanate compound, tolylenedi isocyanate, diphenylmethanediisocyanate, hexamethylenediisocyanate, xylilenediisocyanate, cyclohexylmethanediisocyanate, etc. are used.

It is preferred that the thermoplastic polyester urethane of this invention has a weight-average molecular weight of 5,000 to 500,000, and does not contain a large amount of gel. If the weight-average molecular weight is significantly less than 5,000, then sufficient tenacity cannot be obtained. If the weight-average molecular weight significantly exceeds 500,000 or if there is a large amount of gel, then the fixability may become poor. The amount of the thermoplastic polyester urethane chemically bonded to the vinyl copolymer is preferably 0.01–30 wt %, more preferably 0.1–25 wt % of the total resin composition.

The effect of this invention can be obtained if the amount of the chemically bonded thermoplastic polyester urethane is about 0.01 wt % or more. If it is significantly less than 0.01 wt % or 0, then it may be necessary to separately add (mix) the thermoplastic polyester urethane to obtain a mixture (blend).

If the amount of the thermoplastic polyester urethane exceeds 30 wt %, then the fixability of the resulting toner may become poor, or the dispersibility may become poor, causing fogging. The toner resin composition of this invention can be prepared as follows:

Synthesis of the vinyl copolymer can be accomplished by prior art polymerization methods such as suspension polymerization, emulsion polymerization, solution polymerization or bulk polymerization. The vinyl copolymer and the thermoplastic polyester urethane can be chemically bonded or blended by thermal fusion blending. In order to obtain a more uniform product, however, it is preferable to chemically bind the vinyl copolymer and the thermoplastic polyester urethane while they are dispersed in a solvent. More preferable is to polymerize the vinyl copolymer in the presence of the thermoplastic polyester urethane and thus obtain a toner resin composition comprising the vinyl copolymer to which the thermoplastic polyester urethane is chemically bonded even more uniformly.

The chemical bonding mentioned above can be achieved through a dehydration reaction between hydroxyl groups at the end of polyurethane and carboxyl groups of styrene acrylic resin obtained by copolymerizing monomers containing carboxyl groups, or by using dicarbonic acid or diisocyanate to bind styrene acrylic resin obtained by copolymerizing monomers containing hydroxyl groups and hydroxyl groups at the end of polyurethane. Bonding can be in any fashion, graft type or block type, as long as chemical bonding is achieved. For better aggregation properties, the glass transition temperature of the toner resin composition of this invention is preferably 50° C. or higher.

In the toner resin composition of this invention, vinyl acetate, vinyl chloride or ethylene can be copolymerized into the vinyl copolymer, or polymers of these monomers can be blended, as long as the object of this invention can be achieved. Polyester resin and/or epoxy resin can also be blended in the vinyl copolymer. Furthermore, aliphatic amide, bis aliphatic amide, metallic soap, paraffin, etc. can be mixed in the toner resin composition.

Anti-static additives including dyes such as NIGROSINE and SPIRON-BLACK (from Hodogaya Kagaku) and/or phthalocyanine pigments can also be added, as long as the object of this invention can be achieved. For coloring, carbon black, chrome yellow, aniline blue, etc. can be added as appropriate. Toner-releasing agents such as low molecular weight polyester or polypropylene wax can also be added. It is also possible to add hydrophobic silica and such to increase flowability.

The toner resin composition of this invention has improved low temperature fixability and anti-offset properties because the vinyl copolymer comprises the lower molecular weight polymer component and the higher molecular weight polymer component. Since the thermoplastic polyester urethane of the molecular weight as specified above is bonded to or blended in the vinyl copolymer at the ratio specified above, tenacity of the toner resin composition is increased without sacrificing the low temperature fixability, anti-aggregation and anti-offset properties. Therefore, a toner which does not cause smearing and image fogging, especially image fogging during the run, can be obtained. By using the toner resin composition of this invention to prepare a toner for the dry developing method, it is possible to reduce power consumption and increase the copy speed without sacrificing the copy quality.

This invention is described in detail below by referring to examples and comparative examples. Hereafter, "part" means "weight part" unless specified otherwise.

EXAMPLE 1

A mixture of 135 g of a resin with a molecular weight peak at 400,000, obtained by polymerizing 72 parts of styrene, 8 parts of methyl methacrylate, 2 parts of methacrylic acid and 18 parts of n-butyl acrylate, and 50 g of a thermoplastic polyester urethane (from Sumitomo Bayer Urethane, product name: DESMOCOLL 110) were charged into a 3-liter separable flask and dissolved in 1 liter of xylene. After the gas was replaced by nitrogen gas, this system was heated to the boiling point of xylene.

After the refluxing of xylene had begun, a mixture of 227 g of styrene, 25 g of methyl methacrylate, 6 g of methacrylic acid, 57 g of n-butyl acrylate and 6 g of azobisisobutyronitrile (AIBN) was dripped into the system for 2 hours, and then 0.1 g of p-toluenesulfonic acid monohydrate was added to the system. The lower molecular weight polymer was polymerized by 1 hour of agitation while water was removed. The system temperature was then gradually raised to 180° C., and xylene was removed under reduced pressure to obtain resin A which has a peak value of the molecular weight of the lower molecular weight polymer component of 10,000 and a glass transition temperature of 60° C. The total amount of the thermoplastic polyester urethane in this resin A was 10 wt %.

100 parts of resin A, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 660P) were melt-blended, cooled, coarsely pulverized and then finely pulverized with a jet-mill to obtain toner powder with an average particle size of approximately 12–15 micrometers. Toner was prepared by adding 0.3 parts of hydrophobic silica powder (from Aerosil Japan, Ltd., product name: R-972) to the toner powder thus obtained.

10 g of this toner was placed into a 100 ml sample bottle, and held for 8 hours in a 50° C. thermostatic bath, followed by measurement of degree of aggregation using a powder tester (from Hosokawa Micron, Ltd.). No aggregation was observed. 4 parts of this toner and 96 parts of iron powder carrier with an average particle size of approximately 50–80 micrometers were mixed to prepare a developing agent, and this developing agent was used in an electronic copier to obtain copies. The electronic copier used was DC-4085 from Mita Kogyo, Ltd. Copies were made for various temperatures of the heated roller of the electronic copier. Said copies were then rubbed with an ink eraser for typewriters, and the lowest temperature setting at which the density of the copy images did not change after rubbing was defined as the fixing temperature. The fixing temperature of the developing agent using resin A was 150° C., which was sufficiently low.

The offset occurring temperature was defined as the lowest temperature setting at which the offset phenomenon occurs when obtaining copies with various temperature settings of the heated roller of the electronic copier. The offset occurring temperature of the developing agent using resin A was 200° C. or higher, which was sufficiently high. For images fixed at 170° C., no fogging was observed and no smearing was observed after rubbing the surface with gauze. A running test was conducted to obtain 20,000 copies at the fixing temperature of 170° C., and no image fogging was observed.

EXAMPLE 2

500 g of a mixture comprising 68 wt % of a resin with a molecular weight peak at 5,000, obtained by polymerizing 80 parts of styrene, 6 parts of methyl methacrylate, 4 parts of methacrylic acid and 10 parts of 2-ethylhexyl acrylate, 23 wt % of a resin with a molecular weight peak at 800,000, obtained by polymerizing 80 parts of styrene and 20 parts of n-butyl methacrylate, and 10 wt % of a thermoplastic polyester urethane with a weight-average molecular weight of approximately 100,000 (from Dainippon Ink and Chemicals, Inc., product name: Pandex T-5210) were charged into a 3-liter separable flask and dissolved in 1 liter of xylene. After the gas was replaced by nitrogen gas, this system was heated to the boiling point of xylene.

After the refluxing of xylene had begun, 0.1 g of p-toluenesulfonic acid monohydrate was added to the system. Then two hours of agitation was conducted while water was removed. The system temperature was then gradually raised to 180° C., and xylene was removed under reduced pressure to obtain resin B which has a glass transition temperature of 62° C.

100 parts of resin B, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 550P) were melt-blended, cooled, coarsely pulverized and then finely pulverized with a jet-mill to obtain toner powder with an average particle size of approximately 12–15 micrometers. Toner was prepared by adding 0.3 parts of hydrophobic silica powder (from Aerosil Japan, Ltd., product name: R-972) to the toner powder thus obtained.

The degree of aggregation of this toner was measured in the same manner as in Example 1. No aggregation was observed. Copies were made using the toner mentioned above in the same manner as in Example 1, and fixability and anti-offset properties were evaluated. The fixing temperature was measured in the same manner as in Example 1. The fixing temperature of the developing agent using resin B was 150° C., which was sufficiently low. Also, the offset occurring temperature was evaluated in the same manner as in Example 1. The offset occurring temperature of the developing agent using resin B was 200° C. or higher, which was sufficiently high. No fogging was observed in images fixed at 170° C., and no smearing was observed after rubbing with a finger. A running test was conducted in the same manner as in Example 1, and no image fogging was observed.

EXAMPLE 3

40 g of a thermoplastic polyester urethane with a weight-average molecular weight of approximately 200,000 (from Sumitomo Bayer Urethane, product name: DESMOCOLL 400), 300 g of styrene, 110 g of n-butyl acrylate, 700 g of toluene, and 0.3 g of a initiator KAYA-ESTER HTP (from Kayaku Nuley, Ltd.) were charged into a 3-liter separable flask. After the gas was replaced by nitrogen gas, this system was heated to the boiling point of toluene.

After the refluxing of toluene had begun, polymerization was carried out by a 10-hour agitation to obtain the higher molecular weight polymer. A mixture of 390 g of styrene, 50 g of methacrylic acid, 110 g of n-butyl methacrylate and 10 g of AIBN was dripped into the system for 2 hours, and then 0.2 g of p-toluenesulfonic acid monohydrate was added to the system. The lower molecular weight polymer was polymerized by 3 hours of agitation while water was removed. The system temperature was then gradually raised to 180° C., and toluene was removed under reduced pressure to obtain resin C which has molecular weight peaks of 20,000 and 250,000, and a glass transition temperature of 57° C. The total amount of the thermoplastic polyester urethane in this resin C was 4 wt %.

100 parts of resin C, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 550P) were melt-blended, cooled, coarsely pulverized and then finely pulverized with a jet-mill to obtain toner powder with an average particle size of approximately 12–15 micrometers. Toner was prepared by adding 0.3 parts of hydrophobic silica powder (from Aerosil Japan, Ltd., product name: R-972) to the toner powder thus obtained.

The degree of aggregation of this toner was measured in the same manner as in Example 1. No aggregation was observed. A developing agent was prepared by using the toner mentioned above in the same manner as in Example 1 and copies were made to evaluate fixability and anti-offset properties. The fixing temperature was 150° C., which was sufficiently low. The offset occurring temperature was 200° C. or higher, which was sufficiently high. No fogging was observed in images fixed at 170° C., and no smearing was observed after rubbing with a finger. A running test was conducted in the same manner as in Example 1, and no image fogging was observed.

EXAMPLE 4

500 g of polyester (from Huls America, Inc., product name: DYNACOLL RP-7380), 15 g of hexamethylenediisocyanate and 1 liter of toluene were charged into a 3-liter separable flask, and, while the mixture was being heated and agitated, 0.1 g of dibutyl tin laurate was added. Toluene was removed by high temperature depressurization to obtain the thermoplastic polyester urethane D with a weight-average molecular weight of 50,000.

A mixture of 135 g of a resin with a molecular weight peak at 400,000, obtained by polymerizing 72 parts of styrene, 10 parts of methyl methacrylate and 18 parts of n-butyl acrylate, and 100 g of thermoplastic polyester urethane D was charged into a 3-liter separable flask and dissolved in 1 liter of xylene. After the gas was replaced by nitrogen gas, this system was heated to the boiling point of xylene. After the refluxing of xylene had begun, a mixture of 217 g of styrene, 18 g of methyl methacrylate, 8 g of methacrylic acid, 22 g of n-butyl acrylate and 6 g of AIBN was dripped into the system for 2 hours. 0.1 g of p-toluenesulfonic acid monohydrate was then added to the system. One hour of agitation was conducted while water was removed to polymerize the lower molecular weight polymer. After that, the system temperature was gradually raised to 180° C., and xylene was removed under reduced pressure to obtain resin E which has a molecular weight peak of the lower molecular weight polymer component at 10,000 and a glass transition temperature of 64° C. The total amount of the thermoplastic polyester urethane in resin E was 20 wt %.

A developing agent was prepared and tested in the same manner as in Example 1. No aggregation was observed. The fixing temperature was 150° C., and the offset occurring temperature was 200° C. or higher. No fogging was observed in images fixed at 170° C., and no smearing was observed after rubbing with gauze. No image fogging was observed in the running test.

EXAMPLE 5

600 g of dodecanedioic acid and 420 g of 1, 6-hexanediol were charged into a 3-liter separable flask, and, after heating the system up to 100° C. and adding 0.1 g of p-toluenesulfonic acid monohydrate, the polymerization reaction was carried out, along with a dehydration reaction, for 2 hours at 150° C. Under reduced pressure, the temperature of the system was raised to 200° C. to treat residual glycol, and thus polyesterdiol F with a weight-average molecular weight of 2,000 was obtained.

A reaction was carried out in the same manner as in Example 4, except for adjustment of the amount of isocyanate, to obtain thermoplastic polyester urethane G with a weight-average molecular weight of 20,000. A mixture of 135 g of a resin with a molecular weight peak at 400,000, obtained by polymerizing 72 parts of styrene, 8 parts of methyl methacrylate, 2 parts of methacrylic acid and 18 parts of n-butyl acrylate, and 50 g of thermoplastic polyester urethane G were charged into a 3-liter separable flask and dissolved in 1 liter of xylene. After the gas was replaced by nitrogen gas, this system was heated to the boiling point of xylene.

After the refluxing of xylene had begun, a mixture of 250 g of styrene, 18 g of methyl methacrylate, 8 g of methacrylic acid, 35 g of n-butyl acrylate and 6 g of AIBN was dripped into the system for 2 hours, and then 0.1 g of p-toluenesulfonic acid monohydrate was added to the system. The lower molecular weight polymer was polymerized by 1 hour of agitation while water was removed. The system temperature was then gradually raised to 180° C., and xylene was removed under reduced pressure to obtain resin H which has a molecular weight peak of the lower molecular weight polymer component at 10,000 and a glass transition temperature of 62° C. The total amount of the thermoplastic polyester urethane in resin H was 10 wt %.

A developing agent was prepared and tested in the same manner as in Example 1. No aggregation was observed. The fixing temperature was 150° C., and the offset occurring temperature was 200° C. or higher. No fogging was observed in images fixed at 170° C., and no smearing was observed after rubbing with gauze. No image fogging was observed in the running test.

EXAMPLE 6

A mixture of 100 g of a resin with a molecular weight peak at 800,000, obtained by polymerizing 75 parts of styrene and 25 parts of n-butyl acrylate, and 10 g of a thermoplastic polyester urethane G were charged into a 3-liter separable flask and dissolved in 1 liter of xylene. After the gas was replaced by nitrogen gas, this system was heated to the boiling point of xylene. After the refluxing of xylene had begun, a mixture of 340 g of styrene, 40 g of n-butyl acrylate, 10 g of acrylic acid, and 7 g of AIBN was dripped into the system for 2 hours, and then 0.1 g of p-toluenesulfonic acid monohydrate was added to the system. The lower molecular weight polymer was polymerized by 1 hour of agitation while water was removed. The system temperature was then gradually raised to 180° C., and xylene was removed under reduced pressure to obtain resin I which has a molecular weight peak of the lower molecular weight polymer component at 10,000 and a glass transition temperature of 60° C. The total amount of the thermoplastic polyester urethane in this resin I was 2 wt %.

A developing agent was prepared and tested in the same manner as in Example 1. No aggregation was observed. The fixing temperature was 150° C., and the offset occurring temperature was 200° C. or higher. No fogging was observed in images fixed at 170° C., and no smearing was observed after rubbing with gauze. No image fogging was observed in the running test.

COMPARATIVE EXAMPLE 1

A developing agent was prepared in the same manner as in Example 1, except for the fact that thermoplastic polyester urethane was not used this time, and it was evaluated in the same manner as in Example 1. As a result, no aggregation was observed. The fixing temperature was 150° C., and the offset occurring temperature was 200° C. or higher. Smearing of the white areas was observed after rubbing images fixed at 170° C. with gauze. Image fogging was observed in the running test.

COMPARATIVE EXAMPLE 2

A developing agent was prepared in the same manner as in Example 1, except for the following changes: thermoplastic polyester urethane was not used; 1 g of divinyl benzene, as a crosslinking agent, was added to the lower molecular weight polymerization solution to obtain a resin with a peak value of the molecular weight of the lower molecular weight polymer component of 20,000 and a glass transition temperature of 62° C., and this resin was used. The developing agent was evaluated in the same manner as in Example 1. As a result, no aggregation was observed. No smearing was observed after rubbing with gauze. The offset occurring temperature was 200° C. or higher, but the fixing temperature was 170° C., which was rather high. Image fogging was observed in the running test.

COMPARATIVE EXAMPLE 3

A developing agent was prepared in the same manner as in Example 1, except for the fact that 2 wt % of thermoplastic polyester urethane and 98 wt % of the lower molecular weight polymer were melt-mixed, and it was evaluated in the same manner as in Example 1. As a result, no aggregation was observed. The fixing temperature was 140° C., but the offset occurring temperature was 160° C., which was rather low. Smearing of the white areas was observed after rubbing with gauze. Image fogging was observed in the running test.

COMPARATIVE EXAMPLE 4

A mixture comprising 68 wt % of a resin with a molecular weight peak at 5,000, obtained by polymerizing 80 parts of styrene, 10 parts of methyl methacrylate and 10 parts of 2-ethylhexyl acrylate, 23 wt % of a resin with a molecular weight peak at 800,000, obtained by polymerizing 80 parts of styrene and 20 parts of n-butyl methacrylate, and 10 wt % of a thermoplastic polyester urethane (from Dainippon Ink and Chemicals, Inc., product name: PANDEX T-5210) were melt-mixed at 160° C. for 30 minutes by using a kneader to obtain resin J with a glass transition temperature of 62° C.

Using resin J, a developing agent was prepared and tested in the same manner as in Example 1. No aggregation was observed. The fixing temperature was 150° C., and the offset occurring temperature was 200° C. or higher. No smearing was observed after rubbing images fixed at 170° C. with gauze. However, image fogging was observed in the running test of 20,000 copies.

COMPARATIVE EXAMPLE 5

A developing agent was prepared in the same manner as in Example 2, except for the fact that High-Styrene rubber (from Japan Synthetic Rubber Co., Ltd.) was used instead of thermoplastic polyester urethane, and it was evaluated in the same manner as in Example 2. The offset occurring temperature was 200° C. or higher, but aggregation was observed. The fixing temperature was 170° C., which was rather high. Smearing of the white areas was observed after rubbing with gauze. Image fogging occurred from the early stage of the running test.

COMPARATIVE EXAMPLE 6

A developing agent was prepared in the same manner as in Example 3, except for the fact that the amount of the thermoplastic polyester urethane was changed from 40 g to 440 g, and it was evaluated in the same manner as in Example 3. As a result, no aggregation was observed. The offset occurring temperature was 200° C. or higher. No smearing was observed after rubbing with gauze, but the fixing temperature was 170° C., which was rather high. Image fogging occurred from the early stage of the running test.

COMPARATIVE EXAMPLE 7

A developing agent was prepared in the same manner as in Example 5, except for the fact that a thermoplastic polyester urethane with a weight-average molecular weight of 4,000, obtained by using polyesterdiol F, was used instead of the thermoplastic polyester urethane, and it was evaluated in the same manner as in Example 5. No aggregation was observed. The fixing temperature was 150° C., and the offset occurring temperature was 200° C. or higher. Smearing of the white areas was observed after rubbing images fixed at 170° C. with gauze. Image fogging was observed in the running test.

COMPARATIVE EXAMPLE 8

A developing agent was prepared in the same manner as in Example 5, except for the fact that a polyester with a weight-average molecular weight of 20,000 which has the same composition as that of polyesterdiol F, was used instead of the thermoplastic polyester urethane, and it was evaluated in the same manner as in Example 5. No aggregation was observed. The fixing temperature was 150° C., and the offset occurring temperature was 200° C. or higher. Smearing of the white areas was observed after rubbing images fixed at 170° C. with gauze. Image fogging was observed in the running test.

COMPARATIVE EXAMPLE 9

A developing agent was prepared in the same manner as in Example 5, except for the fact that a polyurethane with a weight-average molecular weight of 20,000, composed of 1, 6-hexanediol and hexamethylene diisocyanate, was used instead of the thermoplastic polyester urethane, and it was evaluated in the same manner as in Example 5. No aggregation was observed. The offset occurring temperature was 200° C. or higher. But the fixing temperature was 170° C. No smearing was observed after rubbing the fixed images with gauze. Image fogging occurred in the early stage of the running test.

EXAMPLE 7

A mixture of 135 g of a resin with a molecular weight peak at 400,000, obtained by polymerizing 72 parts of styrene, 10 parts of methyl methacrylate and 18 parts of n-butyl acrylate, and 50 g of a thermoplastic polyester urethane with a weight-average molecular weight of approximately 100,000 (from Sumitomo Bayer Urethane, product name: DESMOCOLL 110) were charged into a 3-liter separable flask and dissolved in 1 liter of xylene. After the gas was replaced by nitrogen gas, this system was heated to the boiling point of xylene.

After the refluxing of xylene had begun, a mixture of 227 g of styrene, 31 g of methyl methacrylate, 57 g of n-butyl acrylate and 9 g of benzoyl peroxide (BPO) was dripped into the system for 2 hours. The lower molecular weight polymer was polymerized by 1 hour of agitation. The system temperature was then gradually raised to 180° C., and xylene was removed under reduced pressure to obtain resin A* which has a peak value of the molecular weight of the lower molecular weight polymer component of 10,000 and a glass transition temperature of 60° C. The total amount of the thermoplastic polyester urethane in this resin A* was 10 wt %.

100 parts of resin A*, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 660P) were melt-blended, cooled, coarsely pulverized and then finely pulverized with a jet-mill to obtain toner powder with an average particle size of approximately 12–15 micrometers. Toner was prepared by adding 0.3 parts of hydrophobic silica powder (from Aerosil Japan, Ltd., product name: R-972) to the toner powder thus obtained.

10 g of this toner was put into a 100 ml sample bottle, and let stand for 8 hours in a 50° C. thermostatic bath, followed by measurement of degree of aggregation using a powder tester (from Hosokawa Micron, Ltd.). No aggregation was observed. 4 parts of this toner and 96 parts of iron powder carrier with an average particle size of approximately 50–80 micrometers were mixed to prepare a developing agent, and this developing agent was used in an electronic copier to obtain copies. The electronic copier used was DC-4085 from Mita Kogyo, Ltd.

Copies were obtained for various temperatures of the heated roller of the electronic copier. Said copies were then rubbed with an ink eraser for typewriters, and the lowest temperature setting at which the density of the copy images did not change after rubbing was defined as the fixing temperature. The fixing temperature of the developing agent using resin A* was 150° C., which was sufficiently low. The offset occurring temperature was defined as the lowest temperature setting at which the offset phenomenon occurs when obtaining copies with various temperature settings of the heated roller of the electronic copier. The offset occurring temperature of the developing agent using resin A* was 200° C. or higher, which was sufficiently high.

For images fixed at 170° C., no fogging was observed and no smearing was observed after rubbing the surface with gauze.

EXAMPLE 8

500 g of a mixture comprising 68 wt % of a resin with a molecular weight peak at 5,000, obtained by polymerizing 80 parts of styrene, 10 parts of methyl methacrylate and 10 parts of 2-ethylhexyl acrylate, 23 wt % of a resin with a molecular weight peak at 800,000, obtained by polymerizing 80 parts of styrene and 20 parts of n-butyl methacrylate, and 10 wt % of a thermoplastic polyester urethane (from Dainippon Ink and Chemicals, Inc., product name: PANDEX T-5210) were charged into a 3-liter separable flask and dissolved in 1 liter of xylene. After the gas was replaced by nitrogen gas, this system was heated to the boiling point of xylene. After the refluxing of xylene had begun, two hours of agitation was conducted. The system temperature was then gradually raised to 180° C., and xylene was removed under reduced pressure to obtain resin B* which has a glass transition temperature of 62° C.

100 parts of resin B*, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 550P) were melt-blended, cooled, coarsely pulverized and then finely pulverized with a jet-mill to obtain toner powder with an average particle size of approximately 12–15 micrometers. Toner was prepared by adding 0.3 parts of hydrophobic silica powder (from Aerosil Japan, Ltd., product name: R-972) to the toner powder thus obtained.

The degree of aggregation of this toner was measured in the same manner as in Example 7. No aggregation was observed. Copies were made using the toner mentioned above in the same manner as in Example 7, and fixability and anti-offset properties were evaluated. The fixing temperature was measured in the same manner as in Example 7. The fixing temperature of the developing agent using resin B* was 150° C., which was sufficiently low.

Also, the offset occurring temperature was evaluated in the same manner as in Example 7. The offset occurring temperature of the developing agent using resin B* was 200° C. or higher, which was sufficiently high. No fogging was observed in images fixed at 170° C., and no smearing was observed after rubbing with a finger.

EXAMPLE 9

40 g of a thermoplastic polyester urethane with a weight-average molecular weight of approximately 200,000 (from Sumitomo Bayer Urethane, product name: DESMOCOLL 400), 300 g of styrene, 110 g of n-butyl acrylate, 700 g of toluene and 0.3 g of a initiator KAYA-ESTER HTP (from Kayaku Nuley, Ltd.) were put into a 3-liter separable flask.

After the gas was replaced by nitrogen gas, this system was heated to the boiling point of toluene. After the refluxing of toluene had begun, polymerization was carried out by a 10-hour agitation to obtain the higher molecular weight polymer. A mixture of 450 g of styrene, 100 g of n-butyl methacrylate and 10 g of azobisisobutyronitrile (AIBN) was dripped into the system for 2 hours, and then the lower molecular weight polymer was polymerized by 3 hours of agitation. The system temperature was then gradually raised to 180° C., and toluene was removed under reduced pressure to obtain resin C* which has molecular weight peak values of 20,000 and 250,000, and a glass transition temperature of 57° C. The total amount of the thermoplastic polyester urethane in this resin C* was 4 wt %.

100 parts of resin C*, 5 parts of carbon black (from Mitsubishi Chemical Industries, Ltd., product name: MA-100), 1 part of SPIRON-BLACK TRH and 3 parts of PP wax (from Sanyo Chemical Industries, Ltd., product name: VISCOL 550P) were melt-blended, cooled, coarsely pulverized and then finely pulverized with a jet-mill to obtain toner powder with an average particle size of approximately 12–15 micrometers.

Toner was prepared by adding 0.3 parts of hydrophobic silica powder (from Aerosil Japan, Ltd., product name: R-972) to the toner powder thus obtained. The degree of aggregation of this toner was measured in the same manner as in Example 7. No aggregation was observed. A developing agent was prepared by using this toner in the same manner as in Example 7 and copies were made to evaluate fixability and anti-offset properties.

The fixing temperature was measured in the same manner as in Example 7, and the measurement was 150° C., which was sufficiently low. The offset occurring temperature was measured in the same manner as in Example 7. The offset occurring temperature of the developing agent using resin C* was 200° C. or higher, which was sufficiently high. No fogging was observed in images fixed at 170° C., and no smearing was observed after rubbing with a finger.

EXAMPLE 10

500 g of polyester (from Huls America, Inc., product name: DYNACOLL RP-7380), 15 g of hexamethylenediisocyanate and 1 liter of toluene were put into a 3-liter separable flask, and, while the mixture was being heated and agitated, 0.1 g of dibutyl tin laurate was added. Toluene was removed by high temperature depressurization to obtain the thermoplastic polyester urethane D* with a weight-average molecular weight of 50,000.

A mixture of 135 g of a resin with a molecular weight peak at 400,000, obtained by polymerizing 72 parts of styrene, 10 parts of methyl methacrylate, and 18 parts of n-butyl acrylate, and 100 g of thermoplastic polyester urethane D* was put into a 3-liter separable flask and dissolved in 1 liter of xylene. After the gas was replaced by nitrogen gas, this system was heated to the boiling point of xylene. After the refluxing of xylene had begun, a mixture of 217 g of styrene, 26 g of methyl methacrylate, 22 g of n-butyl acrylate and 9 g of BPO was dripped into the system for 2 hours, and then one hour of agitation was conducted to polymerize the lower molecular weight polymer. After that, the system temperature was gradually raised to 180° C., and xylene was removed under reduced pressure to obtain resin E* which has a molecular weight peak at the lower molecular weight polymer component of 10,000 and a glass transition temperature of 64° C. The total amount of the thermoplastic polyester urethane in resin E* was 20 wt %.

A developing agent was prepared and tested in the same manner as in Example 7. No aggregation was observed. The fixing temperature was 150° C., and the offset occurring temperature was 200° C. or higher. No fogging was observed in images fixed at 170° C., and no smearing was observed after rubbing with gauze.

EXAMPLE 11

600 g of dodecanedioic acid and 420 g of 1, 6-hexanediol were put into a 3-liter separable flask and, after heating the system up to 100° C. and adding 0.1 g of p-toluenesulfonic acid monohydrate, the polymerization reaction was carried out, along with a dehydration reaction, for 2 hours at 150° C. Under reduced pressure, the temperature of the system was raised to 200° C. to treat residual glycol, and thus polyesterdiol F* with a weight-average molecular weight of 2,000 was obtained.

A reaction was carried out in the same manner as in Example 10, except for an adjustment of the amount of isocyanate, to obtain thermoplastic polyester urethane G* with a weight-average molecular weight of 20,000. A mixture of 135 g of a resin with a molecular weight peak at 400,000, obtained by polymerizing 72 parts of styrene, 10 parts of methyl methacrylate and 18 parts of n-butyl acrylate, and 50 g of thermoplastic polyester urethane G* were put into a 3-liter separable flask and dissolved in 1 liter of xylene. After the gas was replaced by nitrogen gas, this system was heated to the boiling point of xylene. After the refluxing of xylene had begun, a mixture of 250 g of styrene, 26 g of methyl methacrylate, 35 g of n-butyl acrylate and 9 g of BPO was dripped into the system for 2 hours, and the lower molecular weight polymer was polymerized by 1 hour of agitation. The system temperature was then gradually raised to 180° C., and xylene was removed under reduced pressure to obtain resin H* which has a molecular weight peak at the lower molecular weight polymer component of 10,000 and a glass transition temperature of 62° C. The total amount of the thermoplastic polyester urethane in resin H* was 10 wt %.

A developing agent was prepared and tested in the same manner as in Example 7. No aggregation was observed. The fixing temperature was 150° C., and the offset occurring temperature was 200° C. or higher. No fogging was observed in images fixed at 170° C., and no smearing was observed after rubbing with gauze.

COMPARATIVE EXAMPLE 10

A developing agent was prepared in the same manner as in Example 7, except for the fact that thermoplastic polyester urethane was not used this time, and it was evaluated in the same manner as in Example 7. As a result, no aggregation was observed. The fixing temperature was 150° C., and the offset occurring temperature was 200° C. or higher. No fogging was observed in images fixed at 170° C., but smearing was observed after rubbing with gauze.

COMPARATIVE EXAMPLE 11

A developing agent was prepared in the same manner as in Example 7, except for the following changes: thermoplastic polyester urethane was not used; 1 g of divinyl benzene was added to the lower molecular weight polymerization solution to obtain a resin with a peak value of the molecular weight of the lower molecular weight polymer component of 20,000 and a glass transition temperature of 62° C., and this resin was used. The developing agent was evaluated in the same manner as in Example 7. As a result, no aggregation was observed. No image fogging was observed. No smearing was observed after rubbing with gauze. The offset occurring temperature was 200° C. or higher, but the fixing temperature was 170° C., which was rather high.

COMPARATIVE EXAMPLE 12

A developing agent was prepared in the same manner as in Example 7, except for the fact that 2 wt % of thermoplastic polyester urethane and 98 wt % of the lower molecular weight polymer were melt-mixed, and it was evaluated in the same manner as in Example 7. As a result, no aggregation was observed. The fixing temperature was 140° C., and no image fogging was observed. But the offset occurring temperature was 160° C., which was rather low. Smearing of the white areas was observed after rubbing with gauze.

COMPARATIVE EXAMPLE 13

A developing agent was prepared in the same manner as in Example 8, except for the fact that High-Styrene rubber (from Japan Synthetic Rubber Co., Ltd.) was used instead of thermoplastic polyester urethane, and it was evaluated in the same manner as in Example 8. The offset occurring temperature was 200° C. or higher, but aggregation was observed. The fixing temperature was 170° C., which was rather high, and image fogging was observed. Smearing of the white areas was observed after rubbing with gauze.

COMPARATIVE EXAMPLE 14

A developing agent was prepared in the same manner as in Example 9, except for the fact that the amount of the thermoplastic polyester urethane was changed from 40 g to 440 g, and it was evaluated in the same manner as in Example 9. As a result, no aggregation was observed. The offset occurring temperature was 200° C. or higher. No smearing was observed after rubbing with gauze. But the fixing temperature was 170° C., which was rather high, and image fogging was observed.

COMPARATIVE EXAMPLE 15

A developing agent was prepared in the same manner as in Example 11, except for the fact that a thermoplastic polyester urethane with a weight-average molecular weight of 4,000, obtained by using polyesterdiol F*, was used instead of the thermoplastic polyester urethane, and it was evaluated in the same manner as in Example 11. No aggregation was observed. The fixing temperature was 150° C., and the offset occurring temperature was 200° C. or higher. No fogging was observed on the images fixed at 170° C., but smearing of the white areas was observed after rubbing with gauze.

COMPARATIVE EXAMPLE 16

A developing agent was prepared in the same manner as in Example 11, except for the fact that a polyester with a weight-average molecular weight of 20,000 which has the same composition as that of polyesterdiol F*, was used instead of the thermoplastic polyester urethane, and it was evaluated in the same manner as in Example 11. No aggregation was observed. The fixing temperature was 150° C., and the offset occurring temperature was 200° C. or higher. No fogging was observed on the images fixed at 170° C., but smearing of the white areas was observed after rubbing with gauze.

COMPARATIVE EXAMPLE 17

A developing agent was prepared in the same manner as in Example 11, except for the fact that a polyurethane with a weight-average molecular weight of 20,000, composed of 1, 6-hexanediol and hexamethylene diisocyanate, was used instead of the thermoplastic polyester urethane, and it was evaluated in the same manner as in Example 11. No aggregation was observed. The offset occurring temperature was 200° C. or higher. But the fixing temperature was 170° C., and fogging was observed on fixed images. No smearing of the white areas was observed after rubbing the fixed images with gauze.

What is claimed is:

1. A toner resin composition comprising vinyl copolymer as a main component wherein said vinyl copolymer comprises a lower molecular weight polymer component having a peak value of molecular weight distribution of $4*10^3$ to $8*10^4$ and a higher molecular weight component having a peak value of molecular weight distribution of $2*10^5$ to $2*10^6$, said molecular weight distribution being a curve obtained by gel permeation chromatography, and thermoplastic polyester urethane having a weight-average molecular weight of about 5,000 or more and hydroxyl groups at an end of said polyester urethane, said vinyl copolymers comprising structural units of monomers selected from the group consisting of styrene, acrylic acid esters, and methacrylic acid esters to form styrene-acrylic chains having carboxyl groups, said thermo-plastic polyester urethane being chemically bonded to said vinyl copolymer by an ester bond formed between said hydroxyl groups at the end of polyester urethane and carboxyl groups of said styrene-acrylic chains by copolymerizing monomers of said polyester urethane and said vinyl copolymer, wherein said polyester urethane is chemically bonded to said vinyl copolymer in a ratio of 3–10% of the total resin composition.

2. The toner resin composition of claim 1, wherein the weight-average molecular weight of the thermoplastic polyester urethane is between about 500,000 and 5,000.

3. The toner resin composition of claim 1, wherein the thermoplastic polyester urethane is in a crystalline form.

4. The toner resin composition of claim 1, wherein the thermoplastic polyester urethane is linear polyurethane.

5. The toner resin composition of claim 1, wherein the thermoplastic polyester urethane is aliphatic polyurethane.

6. The toner resin composition of claim 1, wherein said toner resin composition has a glass transition of 50° C. or higher.

7. The toner resin composition of claim 1, wherein said higher molecular weight component comprises more than 15 wt % of the total resin composition.

8. The toner resin composition of claim 7, wherein the vinyl copolymer and thermo-plastic polyester urethane are chemically bonded while they are dispersed in a solvent.

9. The toner resin composition of claim 8, wherein the vinyl copolymer is polymerized in the presence of the thermoplastic polyester urethane to chemically bond them together.

10. The toner resin composition of claim 8, wherein chemical bonding of the vinyl copolymer and polyester urethane results in a block type polymer.

11. A toner resin composition comprising vinyl copolymer as a main component wherein said vinyl copolymer comprises a lower molecular weight polymer component having a peak value of molecular weight distribution of $4*10^3$ to $8*10^4$ and a higher molecular weight component having a peak value of molecular weight distribution of $2*10^5$ to $2*10^6$, said molecular weight distribution being a curve obtained by gel permeation chromatography, and thermoplastic polyester urethane of a weight-average molecular weight of between about 5,000 and 500,000, and hydroxyl groups at an end of said polyester urethane, said polyester urethane being a linear polyurethane in crystalline form, said vinyl copolymers comprising structural units of monomers selected from the group consisting of styrene, acrylic acid esters, and methacrylic acid esters to form styrene-acrylic chains having carboxyl groups, said thermo-plastic polyester urethane being chemically bonded to said vinyl copolymer by an ester bond formed between said hydroxyl groups at the end of polyester urethane and carboxyl groups of said styrene-acrylic chains by copolymerizing monomers of said polyester urethane and said vinyl copolymer, wherein said polyester urethane is chemically bonded to said vinyl copolymer in a ratio of 3–10% of the total resin composition, and the resultant toner resin has a glass transition of 50° C. or higher.

12. The toner resin composition of claim 11, wherein the thermoplastic polyester urethane is aliphatic polyurethane.

13. A toner composition comprising vinyl copolymer as a main component wherein said vinyl copolymer comprises a lower molecular weight polymer component having a peak value of molecular weight distribution of $4*10^3$ to $8*10^4$ and a higher molecular weight component having a peak value of molecular weight distribution of $2*10^5$ to $2*10^6$, said molecular weight distribution being a curve obtained by gel permeation chromatography, and thermo-plastic polyester urethane having a weight-average molecular weight of between about 5,000 and 500,000 and hydroxyl groups at an end of said polyester urethane said vinyl copolymers comprising structural units of monomers selected from the group consisting of styrene, acrylic acid esters, and methacrylic acid esters, to form styrene-acrylic chains having carboxyl groups wherein said resin has a glass transition temperature of 50° C. or more, said thermo-plastic polyester urethane being chemically bonded to said vinyl copolymer by an ester bond formed between said hydroxyl groups at the end of polyester urethane and carboxyl groups of said styrene-acrylic chains by copolymerizing monomers of said polyester urethane and said vinyl copolymer, wherein said polyester urethane is chemically bonded to said vinyl copolymer in a ratio of 3–10% of the total resin composition.

* * * * *